US006874596B2

(12) United States Patent
Zeissler et al.

(10) Patent No.: US 6,874,596 B2
(45) Date of Patent: Apr. 5, 2005

(54) SAFETY HARNESS WITH FRONT D RING

(75) Inventors: Brett Richard Zeissler, Sherwood Park (CA); Peter Johnson, Sherwood Park (CA)

(73) Assignee: Safety Direct Ltd., Sherwood Park (CA)

( * ) Notice: Subject to any disclaimer, the term of this patent is extended or adjusted under 35 U.S.C. 154(b) by 0 days.

(21) Appl. No.: 10/244,794

(22) Filed: Sep. 16, 2002

(65) Prior Publication Data

US 2003/0062218 A1 Apr. 3, 2003

(30) Foreign Application Priority Data

Sep. 28, 2001 (CA) ..... 2357885

(51) Int. Cl.[7] ..... A47L 3/04
(52) U.S. Cl. ..... 182/3; 182/6; 182/9; 119/96
(58) Field of Search ..... 182/3, 4, 6, 7, 182/8, 9, 142; 119/96, 857; 244/151 R

(56) References Cited

U.S. PATENT DOCUMENTS

| | | | | | |
|---|---|---|---|---|---|
| 4,197,816 | A | | 4/1980 | Lusch | 119/96 |
| 4,378,921 | A | * | 4/1983 | Allen et al. | 244/151 R |
| 4,553,633 | A | | 11/1985 | Armstrong et al. | 182/3 |
| 4,712,513 | A | | 12/1987 | Huppertsberg | 119/96 |
| 4,991,689 | A | | 2/1991 | Cole | 182/3 |
| 5,203,829 | A | | 4/1993 | Fisk et al. | 119/96 |
| 5,433,289 | A | | 7/1995 | O'Rourke | 182/3 |
| RE35,028 | E | | 8/1995 | Casebolt et al. | 119/857 |
| 5,487,444 | A | | 1/1996 | Dennington | 182/6 |
| 6,006,860 | A | * | 12/1999 | Bell | 182/18 |
| 6,035,440 | A | * | 3/2000 | Woodyard | 2/102 |
| 6,101,631 | A | * | 8/2000 | Ferguson, Jr. | 2/94 |
| 6,125,792 | A | * | 10/2000 | Gee | 119/770 |
| 6,125,966 | A | * | 10/2000 | Jones | 182/3 |
| 6,189,651 | B1 | * | 2/2001 | Sadeck | 182/6 |
| 6,253,874 | B1 | * | 7/2001 | Casebolt et al. | 182/3 |
| RE37,394 | E | * | 10/2001 | Woodyard | 2/102 |
| 6,305,024 | B1 | * | 10/2001 | Schweer | 2/94 |
| 6,308,335 | B1 | * | 10/2001 | Colorado | 2/81 |
| 6,374,946 | B1 | * | 4/2002 | Petzl et al. | 182/6 |
| 6,405,685 | B1 | * | 6/2002 | Cox | 119/857 |
| 6,450,131 | B1 | * | 9/2002 | Broman | 119/857 |
| 6,527,082 | B1 | * | 3/2003 | Taylor | 182/3 |

* cited by examiner

*Primary Examiner*—Bruce A. Lev
(74) *Attorney, Agent, or Firm*—Christensen, O'Connor Johnson Kindness PLLC

(57) ABSTRACT

A safety harness with a front D-ring includes an upper body portion and a lower body portion. A front D-ring is positioned at a front of the upper body portion where a first shoulder strap and a second shoulder strap cross. A single length of webbing is used to form a first end of the first shoulder strap, form a first end of the second shoulder strap and connect the front D-ring in a fixed position relative to the first shoulder strap and the second shoulder strap. The single length of webbing is wrapped around a cross-piece of the front D-ring and the first end of the first shoulder strap is formed from a first loop of the single length of webbing sewn together and the second end of the second shoulder strap is formed from a second loop of the single length of webbing sewn together.

12 Claims, 6 Drawing Sheets

SAFETY HARNESS WITH FRONT D RING

FIELD OF THE INVENTION

The present invention relates to a safety harness with a front D-ring.

BACKGROUND OF THE INVENTION

U.S. Pat. Nos. 5,433,289 (O'Rourke) and RE35,028 (Casebolt et al) both disclose safety harnesses with front D-rings. Most safety harnesses have a rear D-ring adapted for connection to a fall protection safety line. The addition of a front D-ring is a useful innovation that enables personnel to lean back with their weight supported by a safety line or climbing aid connected to the front D-ring. An example of the usefulness of the front D-ring is for transmission tower or ski lift maintenance personnel, who must climb long ladders. The addition of the front D-ring on the harness enables them to lean back with their weight supported by the front D-ring. This can provide respite when climbing up or down the access ladders.

Both the O'Rourke and Casebolt et al references have some inherent drawbacks. With the O'Rourke reference, the front D-ring has an associated friction buckle. The friction buckle allows the positioning of the front D-ring to be adjusted upwardly or downwardly. During use over time, this friction buckle has a tendency to creep upwardly. Should a fall occur which must be arrested by the front D-ring, the front D-ring tends to travel several inches before the friction buckle holds fast. The combination of gradual creep through use and travel when under load has negative consequences. There is a danger that the front D-ring will be positioned too high on the body when a fall is arrested, thereby bringing the safety line into contact with the wearer's face. Another problem with the O'Rourke reference relates to the structural integrity of the safety harness should one of the shoulder straps fail. A severed shoulder strap will pull through the friction buckle, leaving the wearer suspended by a single diagonal shoulder strap and potentially resulting in the wearer being dumped out of the harness. The friction buckle will not work effectively on the one remaining shoulder strap, the weight of the worker will result in the front D-ring moving up as high as possible.

The Casebolt et al reference has a single length of webbing which is wrapped around a cross piece on the front D-ring to form two shoulders straps with one strap extending over a wearer's left shoulder and another strap extending over a wearer's right shoulder. An adjuster link is provided. When adjuster link is spaced from the front D-ring the webbing can slide freely over the cross-piece on the front D-ring. When the adjuster link is positioned against the front D-ring, the adjuster link serves to lock the webbing in position. The adjuster link is more secure than the friction buckle of the O'Rourke reference described above, there is, therefore, a reduction in gradual creep through use and travel when under load. However, a problem remains with the Casebolt et al reference relating to the structural integrity of the safety harness should one of the shoulder straps fail. A severed shoulder strap will pull the single length of webbing through the cross piece of the adjuster link, leaving the wearer with no shoulder straps and potentially resulting in the wearer being dumped out of the harness.

SUMMARY OF THE INVENTION

What is required is a safety harness with a front D-ring which overcomes the disadvantages described above.

According to the present invention there is provided a safety harness with a front D-ring which includes an upper body portion and a lower body portion. The lower body portion includes a first leg strap and a second leg strap. The upper body portion has a front and a back. The upper body portion includes a first shoulder strap having a first end at the front of the upper body portion adapted for connection to the lower body portion and a second end at the rear of the upper body portion adapted for connection to the lower body portion. A second shoulder strap is provided having a first end at the front of the upper body portion adapted for connection to the lower body portion and a second end at the rear of the upper body portion adapted for connection to the lower body portion. The first shoulder strap is crossed with the second shoulder strap at the back of the upper body portion, with a friction buckle and associated rear D-ring positioned at the back of the upper body portion where the first shoulder strap and the second shoulder strap cross. The first shoulder strap is crossed with the second shoulder strap at the front of the upper body portion, with a front D-ring positioned at the front of the upper body portion where the first shoulder strap and the second shoulder strap cross. A single length of webbing is used to form the first end of the first shoulder strap, form the first end of the second shoulder strap and connect the front D-ring in a fixed position relative to the first shoulder strap and the second shoulder strap. The single length of webbing is wrapped around a cross-piece of the front D-ring and the first end of the first shoulder strap is formed from a first loop of the single length of webbing sewn together and the second end of the second shoulder strap is formed from a second loop of the single length of webbing sewn together.

With the safety harness, as described above, the single length of webbing wrapped around the cross-piece of the front D-ring serves to hold the front D-ring in a fixed position. Being wrapped in the webbing it is not subject to gradual creep through use nor to travel when under load.

Further features have been incorporated into the lower body portion in order to provide more convenience and comfort to the wearer. The leg straps are length adjustable to more tightly engage the wearers legs. Length adjustable attachment straps are symmetrically positioned on the lower body portion to allow for the upper body portion to be anchored to the lower body portion and symmetrically cinched down onto the shoulders of the wearer. Releasable locking coupling are provided on each of the leg straps, to enable the lower body portion of the safety harness to be rapidly secured to the wearer's legs. A further releasable locking coupling is provided either where the first length adjustable attachment strap attaches to the first end of the first shoulder strap of the upper body portion or where the second length adjustable attachment strap attaches to the first end of the second shoulder strap of the upper body portion. This enables the upper body portion to be rapidly secured to the wearer's torso. The second end of the first strap and the second end of the second strap of the upper body portion are folded over and sewn together to form loops which interlock with loops on the lower body portion. This joins the upper body portion and the lower body portion together to form a unitary safety harness.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
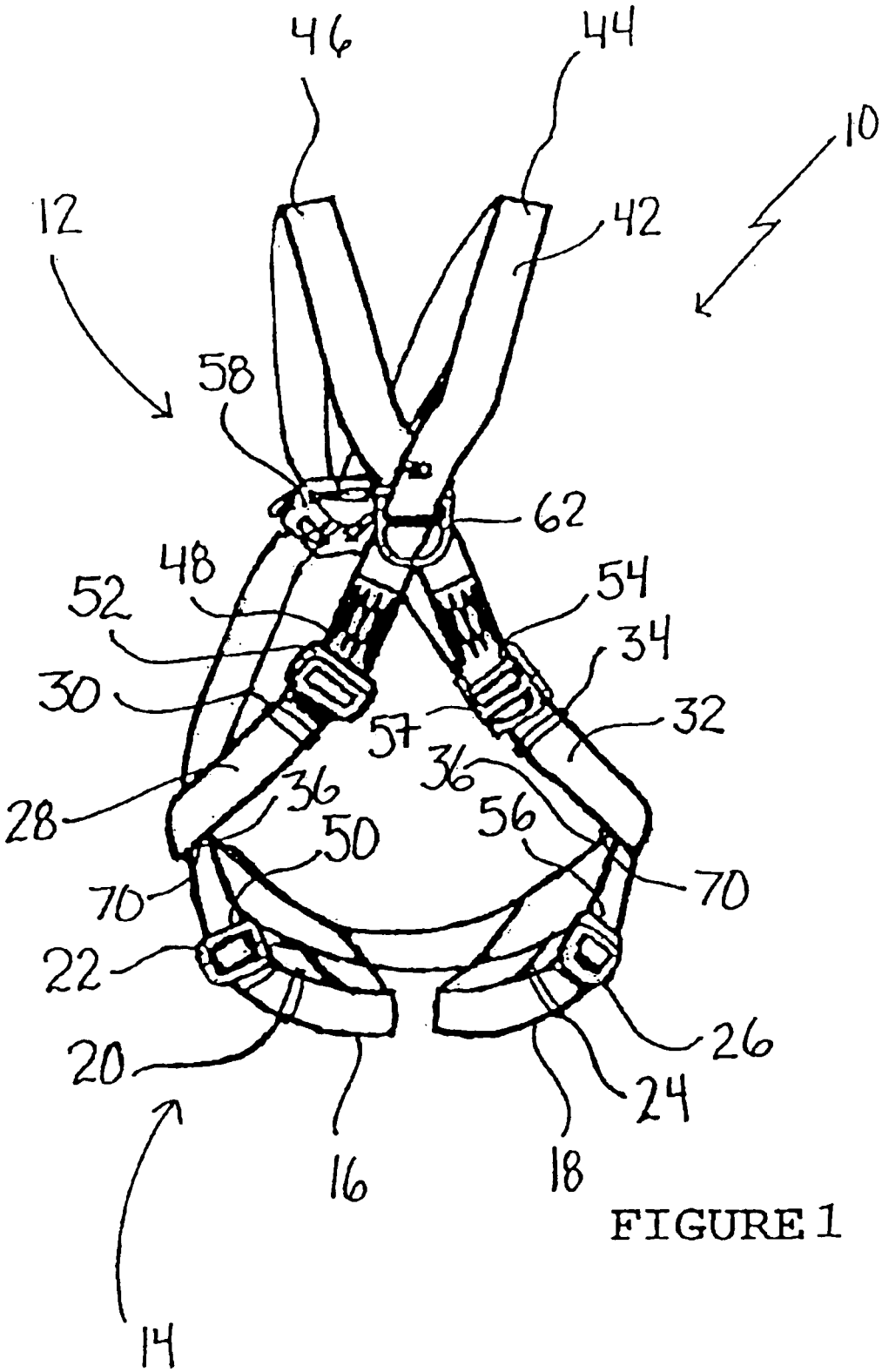
FIG. 1 is a perspective view of a safety harness constructed in accordance with the teachings of the present invention.

The preferred embodiment, a safety harness with a front D-ring generally identified by reference numeral 10, will now be described with reference to FIGS. 1 through 6.

Figure 6:
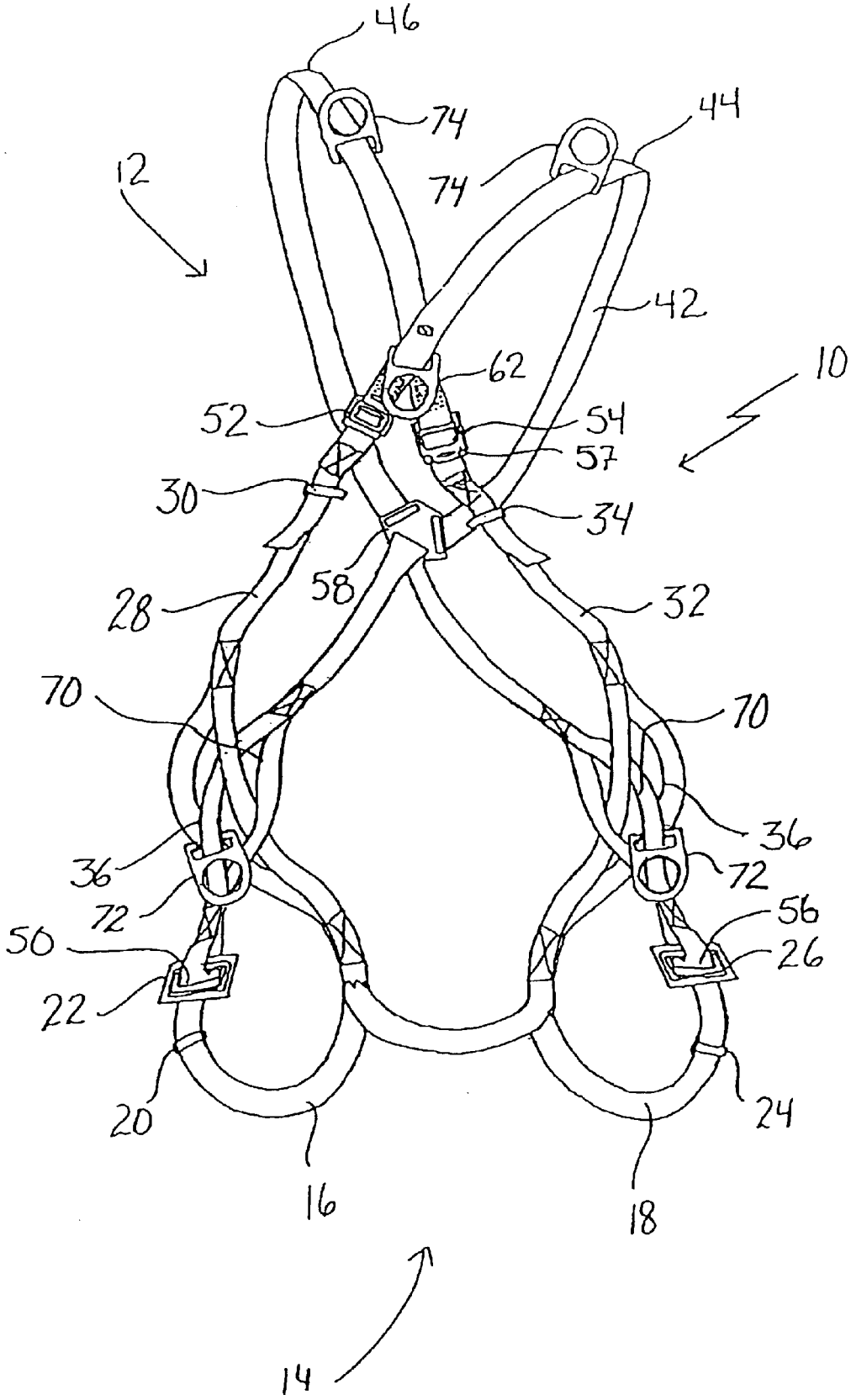
FIG. 6 is a perspective view of the safety harness illustrated in FIG. 1.

Structure and Relationship of Parts:

Referring to FIG. 1, safety harness 10 includes an upper body portion generally indicated by reference numeral 12 and a lower body portion generally indicated by reference numeral 14. Lower body portion 14 includes a first leg strap 16 and a second leg strap 18. First leg strap 16 has a first friction adjustment link 20 for length adjustment and a first releasable locking coupling 22 whereby first leg strap 16 is secured to a person's leg. A second leg strap 18 is provided with a second friction adjustment link 24 for length adjustment and a second releasable locking coupling 26 whereby second leg strap 18 is secured to a person's leg. A first length adjustable attachment strap 28 with a friction adjustment link 30 and a second length adjustable attachment strap 32 with a friction adjustment link 34 are provided for length adjustment. First length adjustable attachment strap 28 and second length adjustable attachment strap 32 are symmetrically positioned on lower body portion 14. Referring to FIG. 6, lower body portion 14 is folded over and sewn together to form loops 36.

Figure 2:
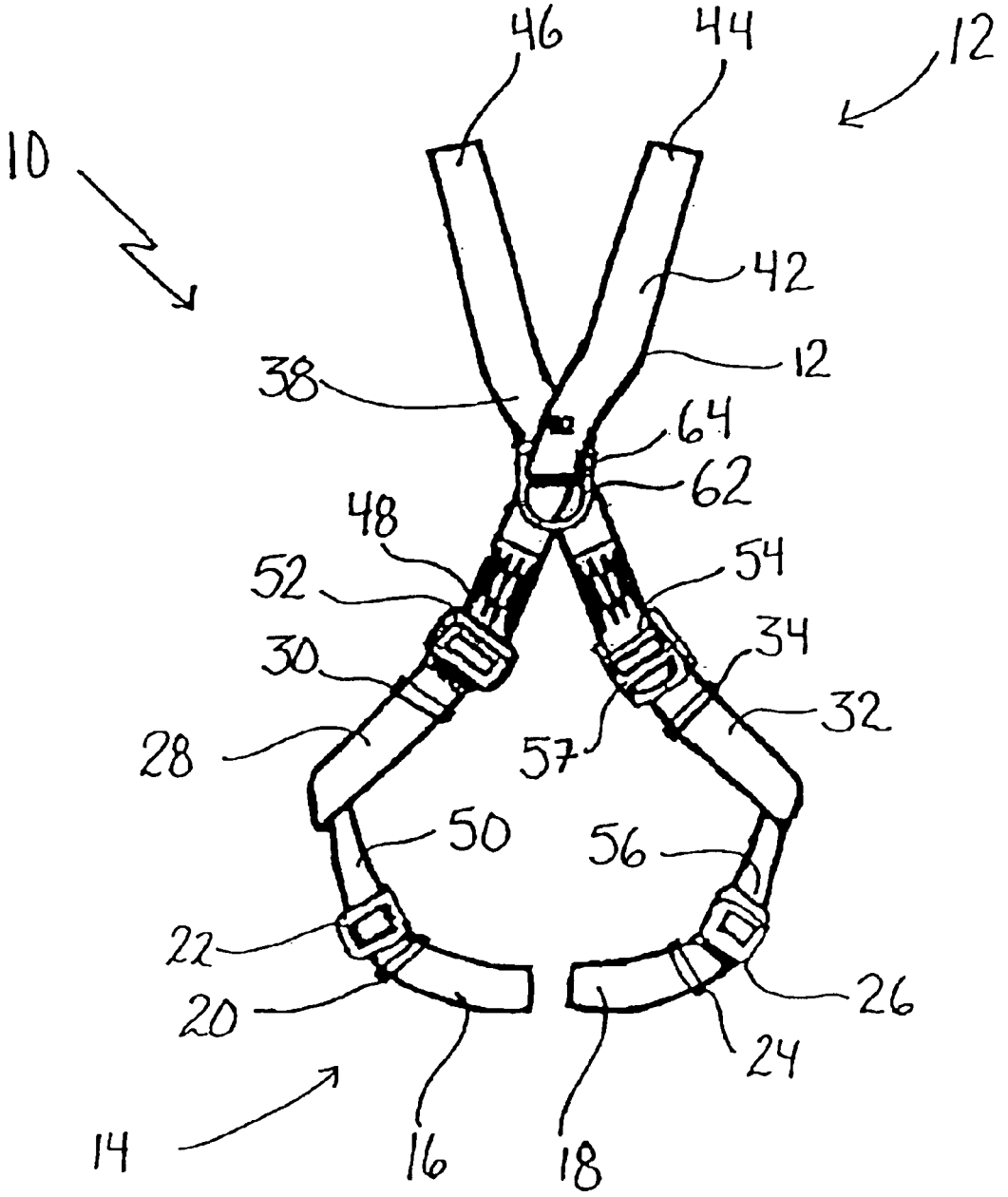
FIG. 2 is a front elevation view of the safety harness illustrated in FIG. 1.
Figure 3:
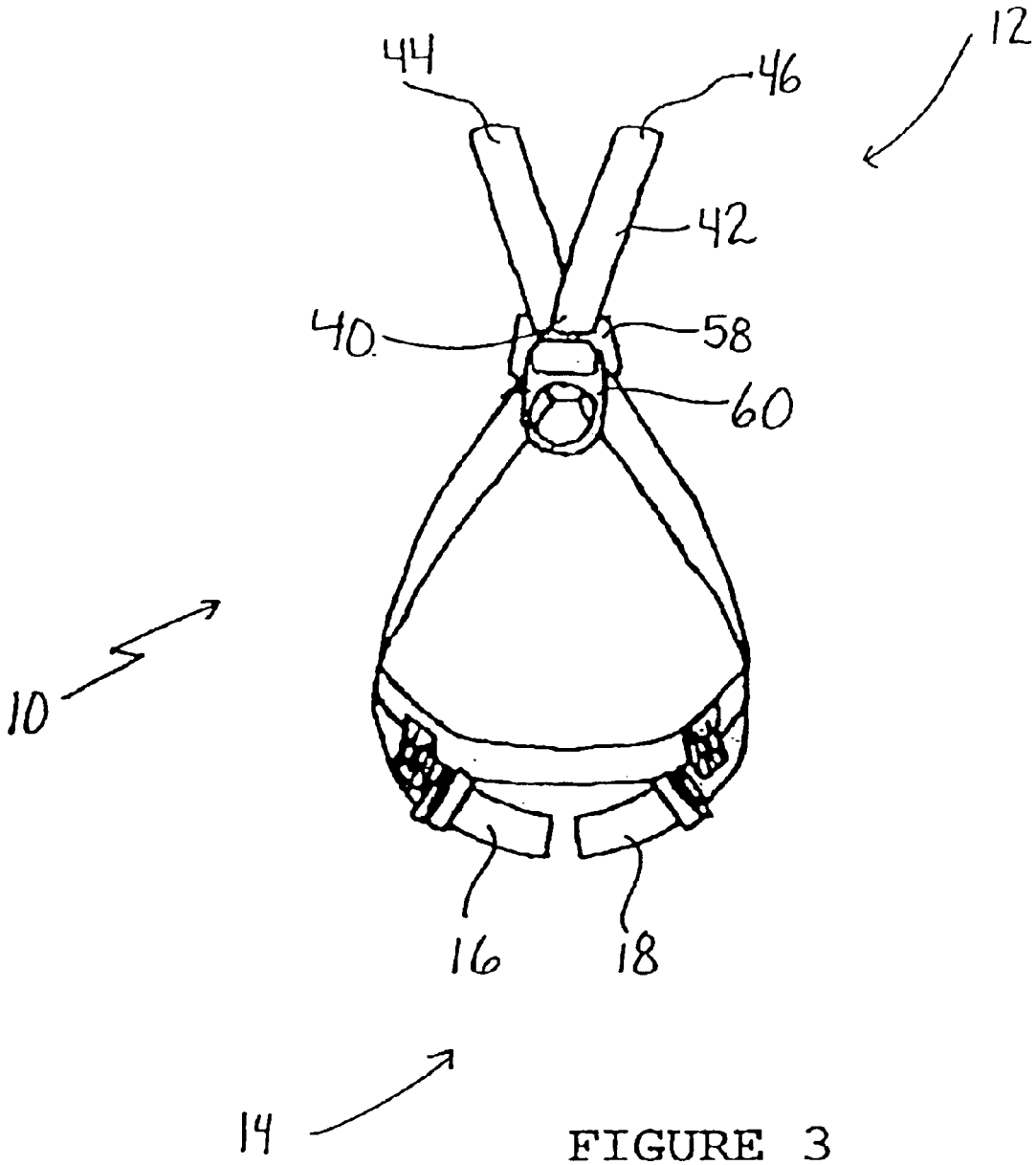
FIG. 3 is a rear elevation view of the safety harness illustrated in FIG. 1.

Upper body portion 12 has a front 38 as illustrated in FIG. 2 and a back 40 as illustrated in FIG. 3. Referring to FIG. 1, upper body portion 12 is entirely formed from a single length of webbing 42. Upper body portion 12 includes a first shoulder strap 44 and a second shoulder strap 46. Referring to FIGS. 2 and 3, first shoulder strap 44 has a first end 48 at front 38 of upper body portion 12 that is adapted for connection to first length adjustable attachment strap 28 of lower body portion 14 and a second end 50 that is adapted for connection by first releasable locking coupling 22 to lower body portion 14. A shoulder strap releasable locking coupling 52 is provided where first length adjustable attachment strap 28 attaches to first end 48 of first shoulder strap 44 of upper body portion 12. Second shoulder strap 46 has a first end 54 at front 38 of upper body portion 12 that is adapted for connection to second length adjustable attachment strap 32 of lower body portion 14 and a second end 56 that is adapted for connection to second releasable locking coupling 26 of lower body portion 14. In the illustrated embodiment, a buckle 57 is used to connect first end 54 of second shoulder strap 46 to second length adjustable attachment strap 32.

Figure 4:
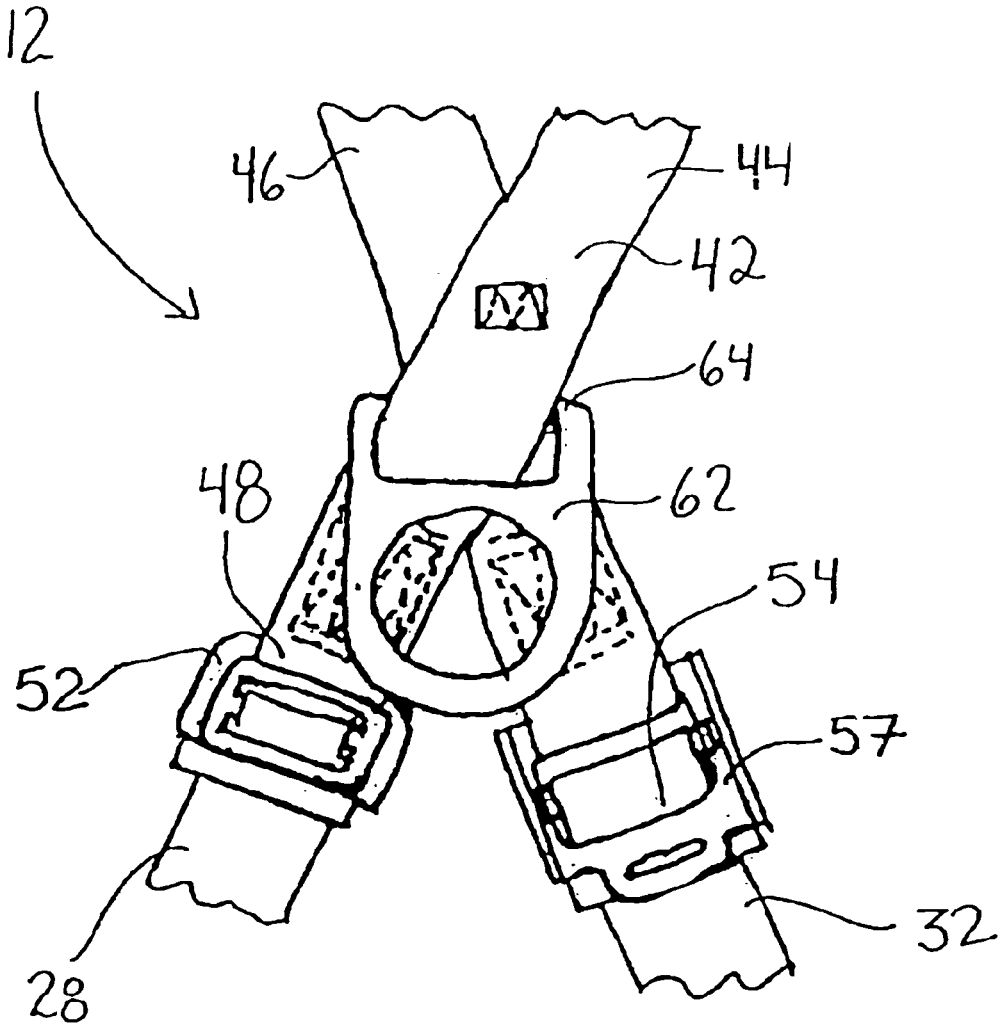
FIG. 4 is a detailed front elevation view of the safety harness illustrated in FIG. 1, showing the front D-ring.
Figure 5:
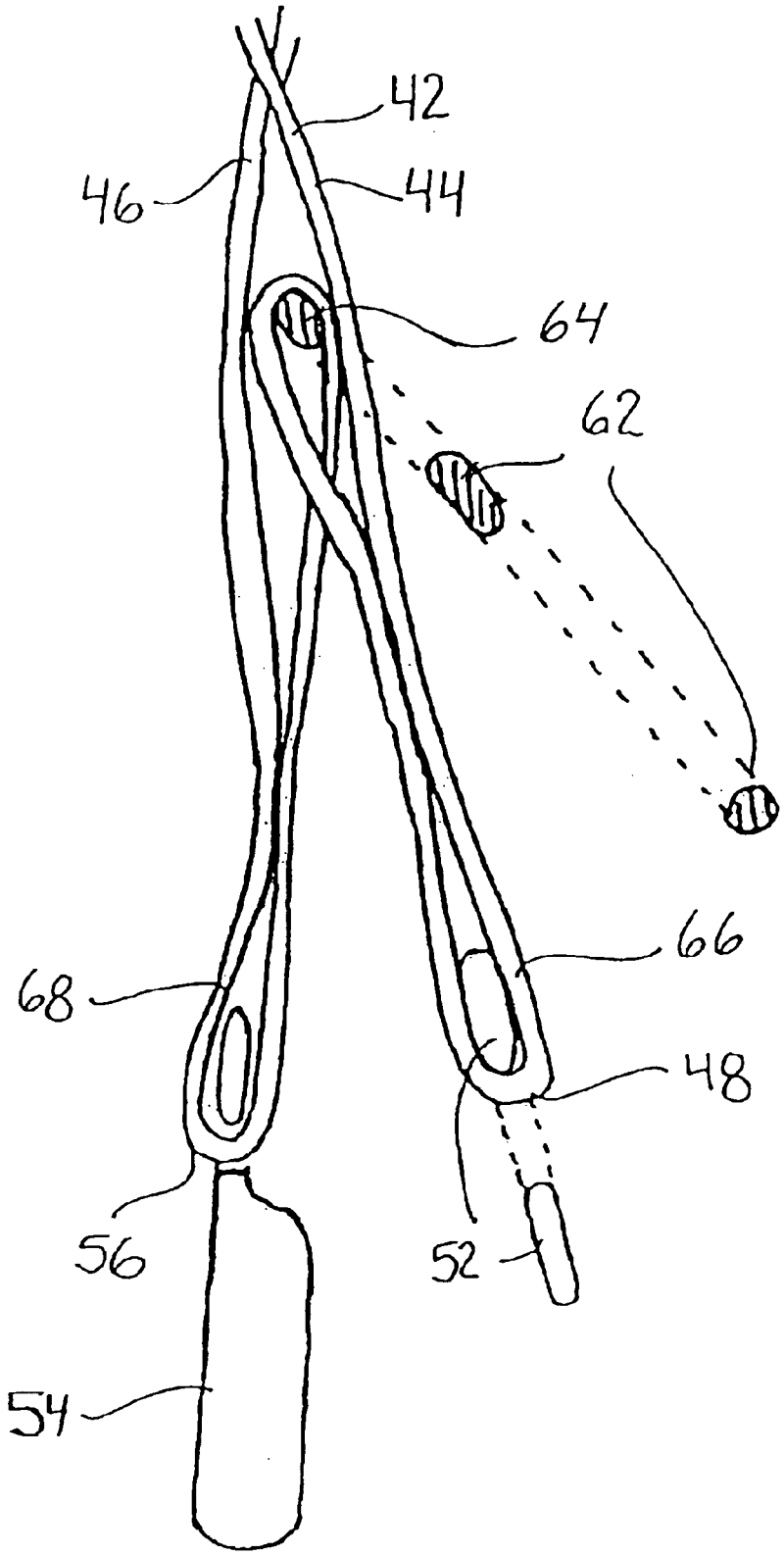
FIG. 5 is a detailed side elevation view of the safety harness illustrated in FIG. 4.

Referring to FIG. 3, first shoulder strap 44 is crossed with second shoulder strap 46 at back 40 of upper body portion 12, with a friction buckle 58 and associated rear D-ring 60 positioned at back 40 of upper body portion 12 where first shoulder strap 44 and second shoulder strap 46 cross. Referring to FIG. 2, first shoulder strap 44 is also crossed with second shoulder strap 46 at front 38 of upper body portion 12, with a front D-ring 62 positioned at front 38 of upper body portion 12 where first shoulder strap 44 and second shoulder strap 46 cross. Referring to FIG. 4, single length of webbing 42 is used to form first end 48 of first shoulder strap 44, to form first end 54 of second shoulder strap 46 as well as connect front D-ring 62 in a fixed position relative to first shoulder strap 44 and second shoulder strap 46. Referring to FIG. 5, single length of webbing 42 is wrapped around a cross-piece 64 of front D-ring 62. First end 48 of the first shoulder strap 44 is formed from a first loop 66 of single length of webbing 42 sewn together and second end 56 of second shoulder strap 46 is formed from a second loop 68 of single length of webbing 42 sewn together. Referring to FIG. 6, second end 50 of first shoulder strap 44 and second end 56 of second shoulder strap 46 of upper body portion 12 are folded over and sewn together to form loops 70 which interlock with loops 36 on lower body portion 14, thereby preventing separation of upper body portion 12 and lower body portion 14.

Operation:

The use and operation of safety harness 10 will now be described with reference to FIGS. 1 through 5. In order to use safety harness 10 as described above, a person would place safety harness so that first shoulder strap 44 is positioned on his or her left shoulder, and second shoulder strap 46 is placed on his or her right shoulder with front D-ring 62 positioned in front of the person and rear D-ring 60 positioned at the back of the person. Safety harness 10 is secured around torso of a person by using shoulder strap releasable locking coupling 52 to attach first end 48 of first shoulder strap 44 to first length adjustable attachment strap 28. First leg strap 16 is secured to one of the legs of a person using first releasable locking coupling 22. Second leg strap 18 is secured to the other leg of a person using second releasable locking coupling 26. First friction adjustment link 20 and second friction adjustment link 24 can be used to adjust the length of first leg strap 16 and second leg strap 18 to ensure a suitable fit. The length of safety harness 10 can then be adjusted using first length adjustable attachment strap 28 with a friction adjustment link 30 and a second length adjustable attachment strap 32 with a friction adjustment link 34.

Once safety harness 10 is properly positioned on an individual, it can be used to provide respite when climbing up or down access ladders.

Variations:

Referring to FIG. 6, additional D-rings 72 can be interwoven into loops 36 and loops 70 to serve as work positioning attachments. This allows for safety harness 10 support person in a relatively comfortable working position while effecting repairs. D-rings 74 could also be placed on first shoulder strap 44 and second shoulder strap 46 to enable upward extraction of a person from a small or confined work area.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A safety harness with a front D-ring, comprising:

a lower body portion including:

a first leg strap;

a second leg strap;

an upper body portion having a front and a back, including:

a first shoulder strap having a first end at the front of the upper body portion adapted for connection to the lower body portion and a second end at the back of the upper body portion adapted for connection to the lower body portion;

a second shoulder strap having a first end at the front of the upper body portion adapted for connection to the lower body portion and a second end at the back of the upper body portion adapted for connection to the lower body portion;

the first shoulder strap being crossed with the second shoulder strap at the back of the upper body portion, with a friction buckle and associated rear D-ring positioned at the back of the upper body portion where the first shoulder strap and the second shoulder strap cross;

the first shoulder strap being crossed with the second shoulder strap at the front of the upper body portion, with a front D-ring positioned at the front of the upper body portion where the first shoulder strap and the second shoulder strap cross, the front D-ring being in a fixed position relative to the first shoulder strap and the second shoulder strap.

2. The safety harness as defined in claim 1, wherein each of the first leg strap and the second leg strap is length adjustable.

3. The safety harness as defined in claim 1, wherein a first length adjustable attachment strap and a second length adjustable attachment strap are symmetrically positioned on the lower body portion with the first length adjustable attachment strap attaching to the first end of the first shoulder strap of the upper body portion and the second length adjustable attachment strap attaching to the first end of the second shoulder strap of the upper body portion.

4. The safety harness as defined in claim 3, wherein a releasable locking coupling is provided where one of the first length adjustable attachment strap attaches to the first end of the first shoulder strap of the upper body portion or the second length adjustable attachment strap attaches to the first end of the second shoulder strap of the upper body portion.

5. The safety harness as defined in claim 1, wherein the upper body portion in its entirety is formed from the single length of webbing.

6. The safety harness as defined in claim 1, wherein a releasable locking coupling is provided on each of the first leg strap and the second leg strap.

7. The safety harness as defined in claim 1, wherein the second end of the first strap and the second end of the second strap of the upper body portion have loops which interlock with loops on the lower body portion, thereby preventing separation of the upper body portion and the lower body portion.

8. The safety harness as defined in claim 7, wherein D-rings are interwoven into one of the loops on the upper body portion or the loops on the lower body portion, thereby serving as work positioning attachments.

9. The safety harness as defined in claim 1, wherein D-rings are placed on the first shoulder strap and the second shoulder strap, thereby enabling upward extraction of a person from a small or confined work area.

10. A safety harness with a front D-ring, comprising:

a lower body portion including:

a first leg strap with a first friction adjustment link for length adjustment and a first releasable locking coupling whereby the first leg strap is adapted to be secured to a person's leg;

a second leg strap with a second friction adjustment link for length adjustment and a second releasable locking coupling whereby the second leg strap is adapted to be secured to a person's leg;

a first length adjustable attachment strap with a friction adjustment link for length adjustment and a second length adjustable attachment strap with a friction adjustment link for length adjustment, the first length adjustable attachment strap and the second length adjustable attachment strap being symmetrically positioned on the lower body portion; and the lower body portion having loops;

an upper body portion having a front and a back, the upper body portion being entirely formed from a single length of webbing, including:

a first shoulder strap having a first end at the front of the upper body portion adapted for connection to the first length adjustable attachment strap of the lower body portion and a second end adapted for connection by the first releasable locking coupling to the lower body portion, a shoulder strap releasable locking coupling being provided where the first length adjustable attachment strap attaches to the first end of the first shoulder strap of the upper body portion;

a second shoulder strap having a first end at the front of the upper body portion adapted for connection to the second length adjustable attachment strap of the lower body portion and a second end adapted for connection to second releasable locking coupling of the lower body portion;

the first shoulder strap being crossed with the second shoulder strap at the back of the upper body portion, with a friction buckle and associated rear D-ring positioned at the back of the upper body portion where the first shoulder strap and the second shoulder strap cross;

the first shoulder strap being crossed with the second shoulder strap at the front of the upper body portion, with a front D-ring positioned at the front of the upper body portion where the first shoulder strap and the second shoulder strap cross, the front D-ring being in a fixed position relative to the first shoulder strap and the second shoulder strap cross; and the second end of the first strap and the second end of the second strap of the upper body portion having loops which interlock with the loops on the lower body portion, thereby preventing separation of the upper body portion and the lower body portion.

11. The safety harness as defined in claim 10, wherein D-rings are interwoven into one of the loops on the upper body portion or the loops on the lower body portion, thereby serving as work positioning attachments.

12. The safety harness as defined in claim 10, wherein D-rings are placed on the first shoulder strap and the second shoulder strap, thereby enabling upward extraction of a person from a small or confined work area.

* * * * *

UNITED STATES PATENT AND TRADEMARK OFFICE

CERTIFICATE OF CORRECTION

PATENT NO. : 6,874,596 B2
APPLICATION NO. : 10/244794
DATED : April 5, 2005
INVENTOR(S) : B.R. Zeissler et al.

It is certified that error appears in the above-identified patent and that said Letters Patent is hereby corrected as shown below:

| COLUMN | LINE | |
|---|---|---|
| 6 (Claim 10, | 52 line 49) | "strap cross; and" should read --strap; and-- |

Signed and Sealed this

Fifth Day of December, 2006

JON W. DUDAS
*Director of the United States Patent and Trademark Office*